United States Patent [19]

Defibaugh et al.

[11] Patent Number: 5,035,650

[45] Date of Patent: Jul. 30, 1991

[54] ELECTRICAL CONNECTOR HAVING AN INNER METAL SHIELD

[75] Inventors: George R. Defibaugh, Mechanicsburg; Benjamin H. Mosser, III, Middletown, both of Pa.

[73] Assignee: AMP Incorporated, Harrisburg, Pa.

[21] Appl. No.: 538,872

[22] Filed: Jun. 15, 1990

[51] Int. Cl.[5] ..... H01R 13/648

[52] U.S. Cl. ..... 439/609; 439/82; 439/747

[58] Field of Search ..... 439/744, 746, 747, 607-610, 439/871, 872, 82, 83

[56] References Cited

U.S. PATENT DOCUMENTS

| | | | |
|---|---|---|---|
| 3,005,174 | 10/1961 | Pifer | 439/607 |
| 4,611,878 | 1/1985 | Hall et al. | 339/186 M |
| 4,637,669 | 10/1985 | Tajima | 339/14 R |
| 4,768,962 | 9/1988 | Kupfer et al. | 439/675 |

FOREIGN PATENT DOCUMENTS

| | | | |
|---|---|---|---|
| 0180484 | 5/1986 | European Pat. Off. | 439/747 |
| 1434402 | 5/1976 | United Kingdom | 439/744 |

*Primary Examiner*—David L. Pirlot
*Attorney, Agent, or Firm*—David L. Smith

[57] ABSTRACT

A dielectric housing (4) of a circular, shielded DIN electrical connector (2) comprises a central block (26) with terminal receiving cavities (18) extending axially therethrough and which cooperates with a hood (30) and a base (28) of the housing (4) to define a circular chamber receiving a circular, stamped and formed metal shield (8). The shield (8) has projecting therefrom a uniplanar latch arm (80) having a head (81) which latches positively against a latching shoulder (88) in a slot in the base. The latch arm (80) is deflected in its own plane by a cam surface in the slot as the latch arm (80) is inserted thereinto and then resiles to allow the head (81) to latch against the shoulder (88).

11 Claims, 7 Drawing Sheets

72
X
72
70
8
68
74
92
72
74
86
88
84
80
78
40
78
14
82
2
76
18
34
39
36
37
18
32
38
37
26
50
52
4
52
52
16
54
54
96
10
104
110
106
116
122
116
120'
124
124
100
120
102
98
108
122
94
120
121
40
40
42
12
46
42
41
46
44
X
44

ELECTRICAL CONNECTOR HAVING AN INNER METAL SHIELD

BACKGROUND OF THE INVENTION

This invention relates to an electrical connector having an inner metal shield, and in particular to a latch for securing the inner shield to the housing of a circular shielded DIN connector for mounting in a vertical position on a circuit board.

There is disclosed in each of U.S. Pat. No. 4,637,669 and U.S. Pat. No. 4,611,878 a shielded electrical connector having a dielectric housing comprising a circular cross section central block formed with axially extending terminal receiving cavities and being surrounded by a hood which defines, in cooperation with the block and a base in the housing, a circular chamber in which is secured an annular inner metal shield.

According to U.S. Pat. No. 4,637,699, the shield is latched in the circular chamber by means of grounding tabs which project from an edge of the shield and through slots in the base and which have struck-out from the planes thereof rectangular tongues free ends of which engage rear edges of the housing. Since such struck-out tongues are of relatively low resilience they do not latch the shield to the housing positively and should the free ends of the grounding tabs, which are exposed at the rear of the housing, be accidentally stubbed against an obstruction, for example a circuit board, the tongues struck-out from the tabs may thereby be plastically deformed so as to take on a permanent set, so that the shield becomes loose in the circular chamber. The shield of U.S. Pat. No. 4,611,878 is secured in its circular chamber by means of hook members which engage support members in the forward part of the hood, and by means of grounding tabs on the shield which are soldered to ground conductors on a circuit board. The shield is not, therefore, positively secured to the housing until the connector has been mounted to the circuit board.

SUMMARY OF THE INVENTION

The present invention provides means to ensure that an inner shield is positively latched in the circular chamber in the housing of a circular DIN connector upon its insertion thereinto, against any forces that would tend to cause the shield to be withdrawn from the circular chamber.

According to the present invention, the base is formed with a latching opening between the central block and the hood, which opening communicates with the circular chamber. A wall of the latching opening defines a first latching shoulder which is substantially parallel with base, and an abutment surface extending between the base and the shoulder. The shield, which has been stamped and formed in one piece, has a circular edge for engaging the base and from which projects a uniplanar cantilever latch arm comprising a stem connected at one end to the base and extending normally thereof, a head on the other end of the stem having a free end from which extends an inclined cam surface which diverges from the stem in a direction towards the circular edge of the shield, and which is connected to the stem, at its end nearest to the circular edge, by a second latching shoulder extending transversely of the stem. The stem is stiffly and resiliently deflectable in its own plane. The shield is inserted into the circular chamber with the latch arm leading so that the head is inserted into the latching opening until the said circular wall of the shield bottoms on the base. During the insertion of the shield into the circular opening, the inclined cam surface of the head engages the abutment surface in the latching opening so that the stem is resiliently deflected in its own plane radially inwardly of the circular wall of shield, until the second latching shoulder on the head passes the first latching shoulder in the latching opening, whereupon the stem of the latch arm resiles so that the second latching shoulder engages behind the first latching shoulder. Whereby the shield is positively latched in the circular chamber.

Any force tending to withdraw the shield from the circular cavity will cause the latch arm to be stressed in its own plane, so that no deformation of the latch arm will, therefore, occur.

The latching opening may communicate with a similar opening in the base through which a spring arm projecting from said circular edge of the shield may extend, the latch arm being spaced from the spring arm in order to allow the latch arm to flex theretowards. The spring arm may be employed electrically to connect the shield to a grounding conductor upon a circuit board upon which the connector is to be mounted.

The latching opening may extend through a peripheral rim on the side of the base remote from the circular chamber, the first latching shoulder being defined by a recess in the peripheral rim.

In practice, the shield will usually be provided with a plurality of latching projections and the housing with a corresponding plurality of latching openings.

The, or each, latch arm, being uniplanar, can easily be produced, by a simple stamping operation as the shield is being made by progressive die forming.

DESCRIPTION OF THE PREFERRED EMBODIMENT

Figure 1:
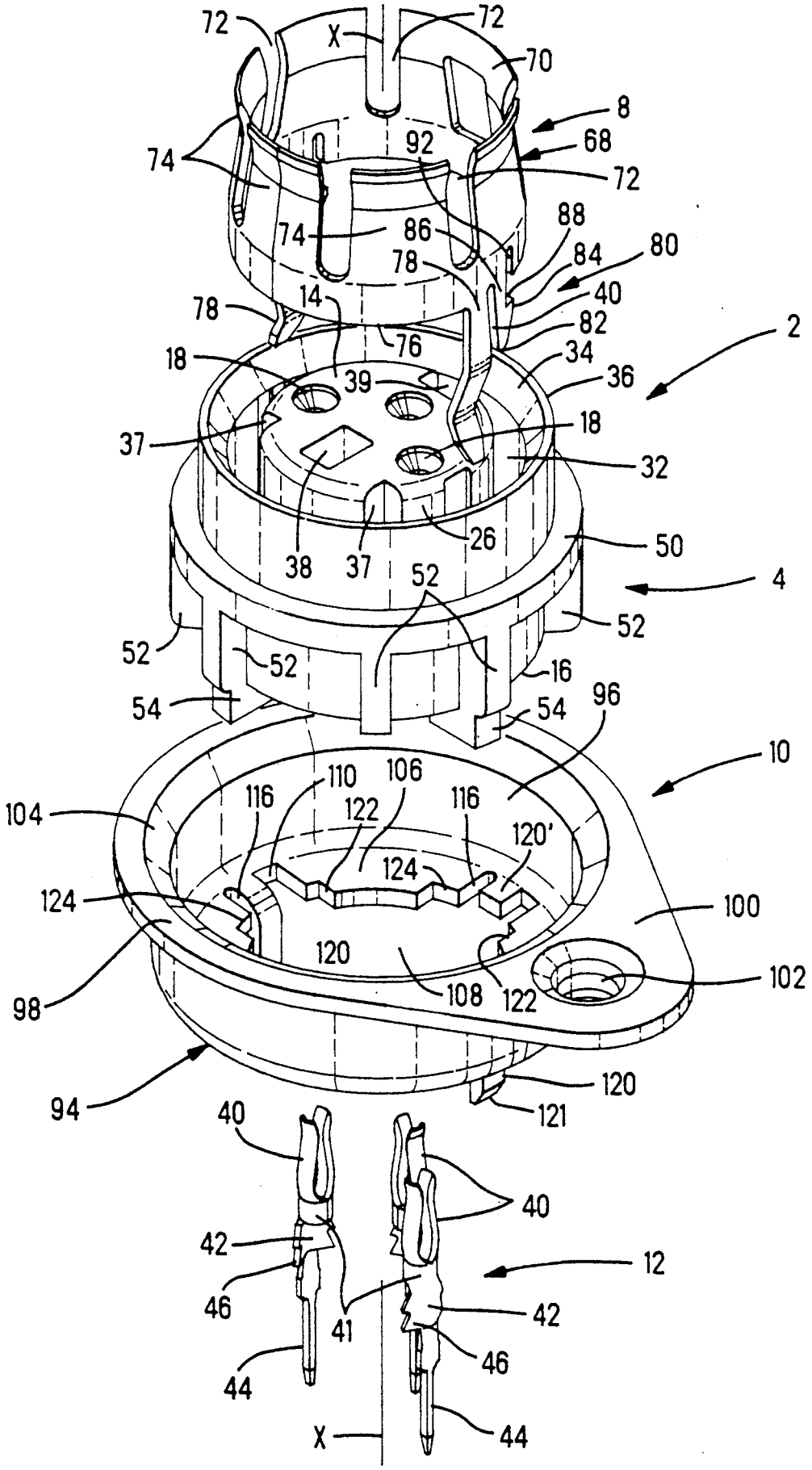
FIG. 1 is an exploded, isometric view of a three position shielded circular DIN electrical receptacle connector for vertical mounting on a printed circuit board and comprising a dielectric housing receiving electrical terminals, a metal inner shield and a metal outer shield.

As best seen in FIG. 1, a three position, circular cross section DIN shielded electrical receptacle connector 2 for vertical mounting on a printed circuit board, comprises a one piece dielectric housing 4, an inner shield 8, an outer shield 10, and three electrical receptacle terminals 12.

Figure 5:
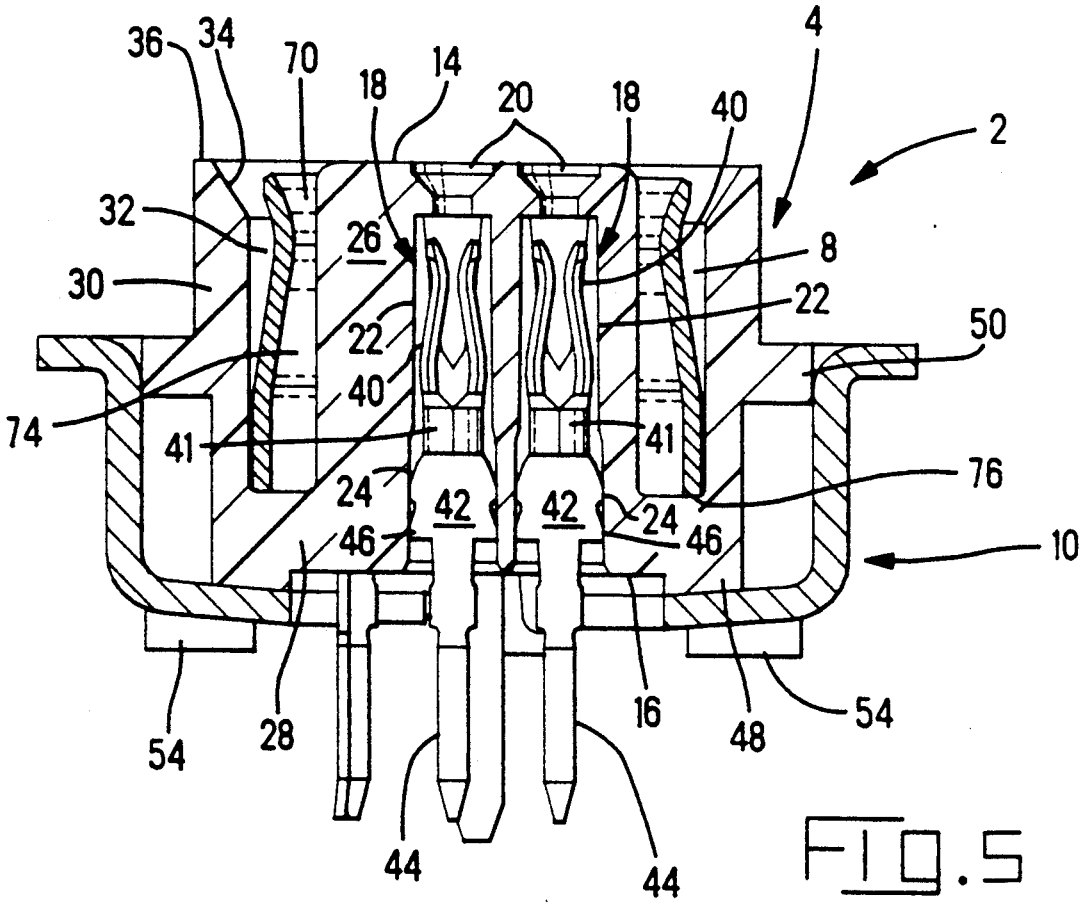
FIG. 5 is a sectional view taken on the lines 5—5 of FIG. 3.
Figure 6:
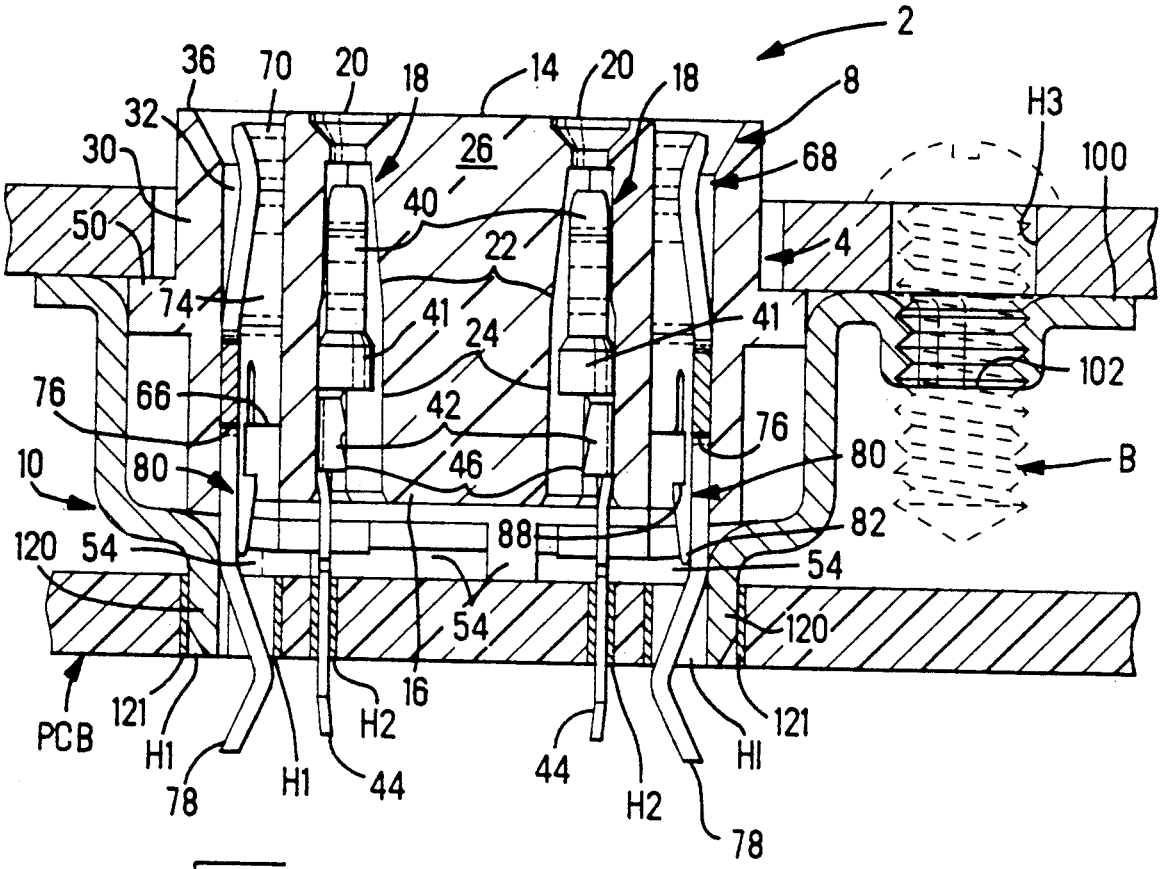
FIG. 6 is a sectional view taken on the lines 6—6 of FIG. 3 showing the connector, when vertically surface mounted on a printed circuit board.

The housing 4 which is of overall circular cross section, has a mating end face 14 and opposite thereto a terminal receiving end face 16 and is formed with three parallel, terminal receiving cavities 18 extended axially of the housing 4 and being spaced from each other about its longitudinally axis X. As best seen in FIGS. 5 and 6, each cavity 18 has an upwardly flared pin guiding mouth 20 opening into the mating face 14 and which communicates with a cylindrical upper cavity portion 22 in turn communicating with a substantially D-cross section lower cavity portion 24 of larger cross sectional area than the portion 22 and which opens into the terminal receiving face 16. The cavities 18 are formed in block 26 of the housing 4, which in the preferred embodiment has a radially central, overall circular cross section. The block 26 projects from a base 28 from which upstands an outer hood 30 coaxial with, and spaced from, the block 26 to define a circular inner shield receiving chamber 32 in co-operation therewith. The hood 30 has an outwardly flared mouth 34 an outer edge 36 of which is flush with the mating face 14. There extends through the central block 26 and the base 28, a rectangular cross section guide keyway 38. The block 26 is also formed with a polarizing features 37 and 39.

Each terminal 12 comprises a pin receptacle part 40, from a circular strap 41 of which extends a channel-shaped retention part 42 from which in turn extends a rectangular cross section contact tail 44. In order to load the housing 4 with terminals 12, each terminal 12 is inserted into a respective cavity 18, by way of the terminal receiving face 16, with its receptacle part 40 leading, so that the latter is received in the upper portion 22 of the cavity 18, the retention part 42 of the terminal 12 being forced into the lower portion 24 of the cavity 18, so that serrations 46 on the part 42 bite into the wall of the cavity portion 24 so as to retain the terminal 12 in its cavity 18, as best seen in FIGS. 5 and 6. In this fully inserted position of the terminal 12, the tail 44 thereof projects below the face 16, substantially normally thereof.

The base 28 has on its underside a raised peripheral rim 48, the hood 30 having substantially mid way between its ends, an external peripheral rib 50 from which extend axially of the hood 30, eight parallel, radially outwardly projecting and circumferentially spaced ribs 52. There depends from the rim 48 and from each of four of the ribs 52 at regularly spaced positions about the rim 48, a stand off and orienting lug 54, the lugs 54 being of equal height.

Figure 3:
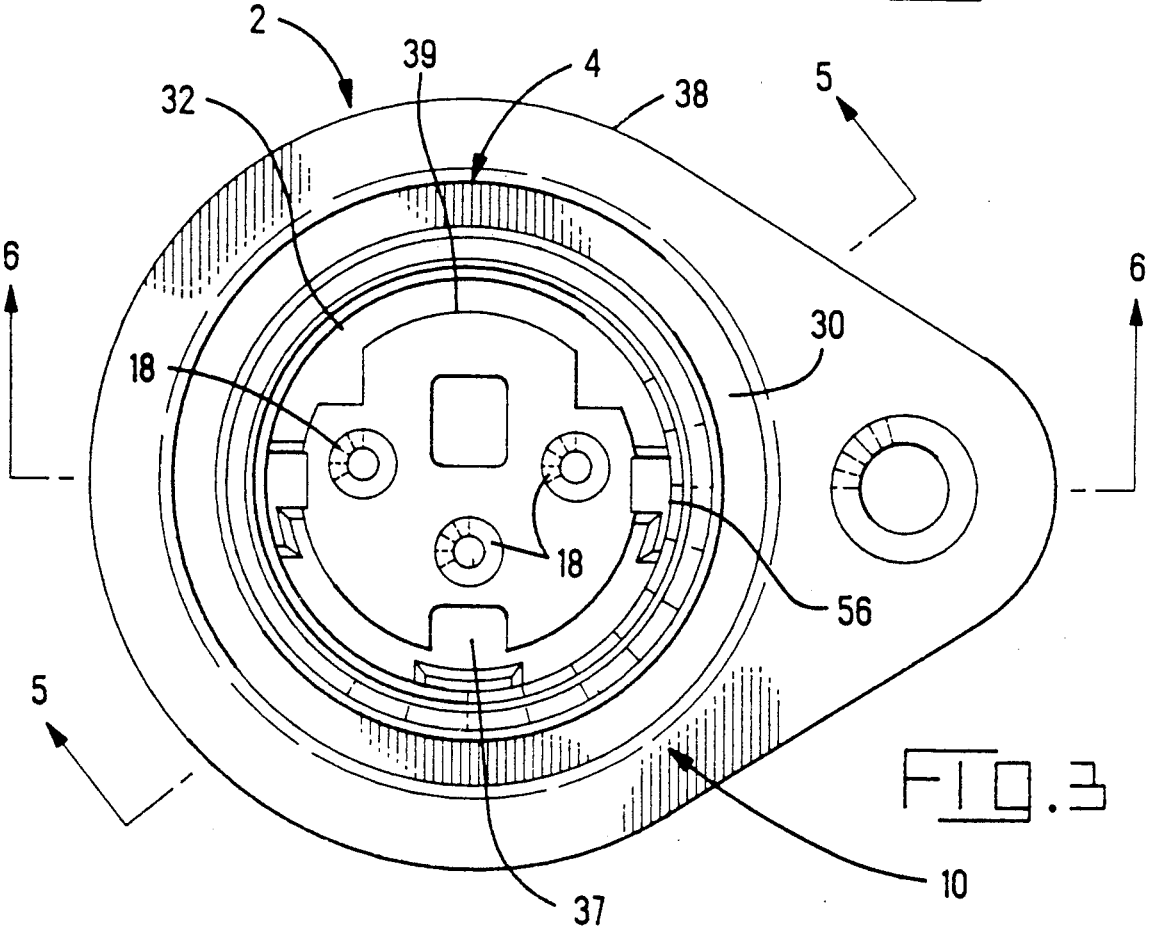
FIG. 3 is a top plan view of the connector.
Figure 4:
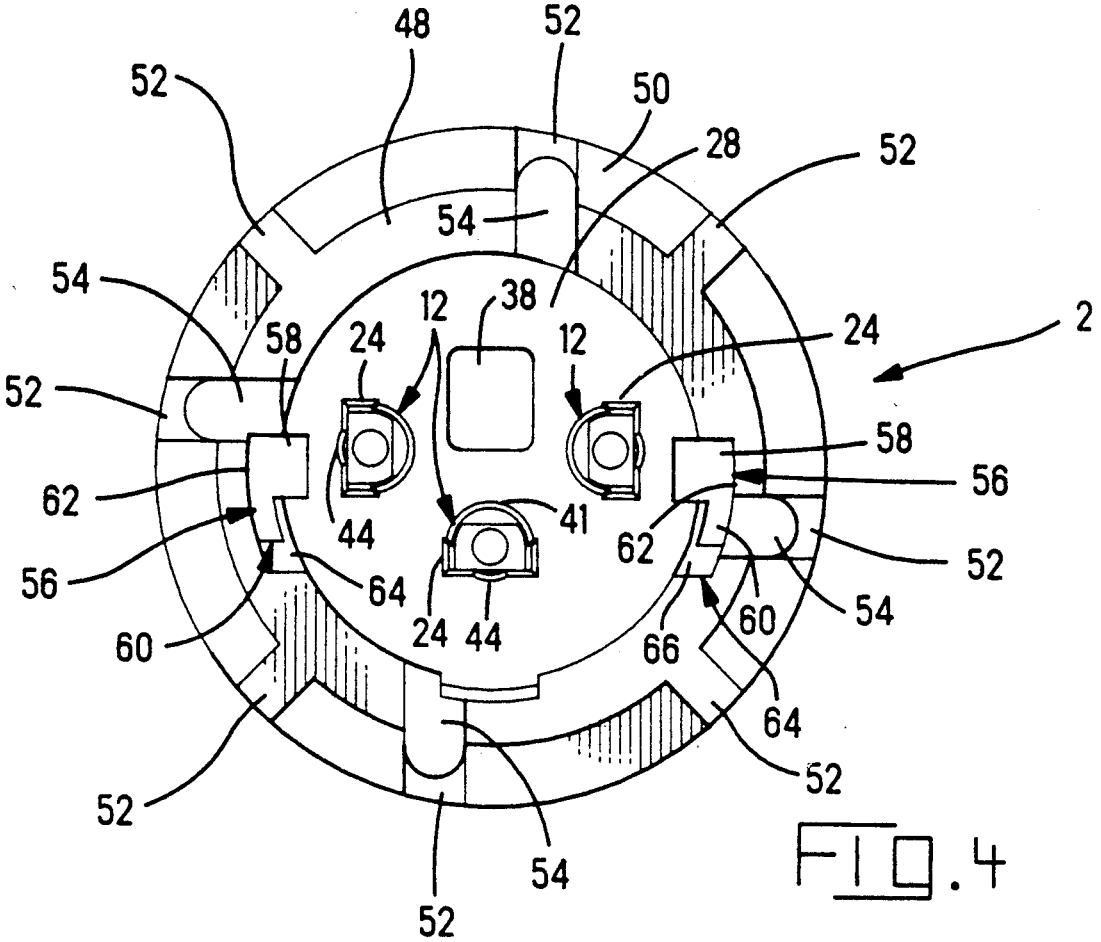
FIG. 4 is a bottom plan view of the dielectric housing.
Figure 7:
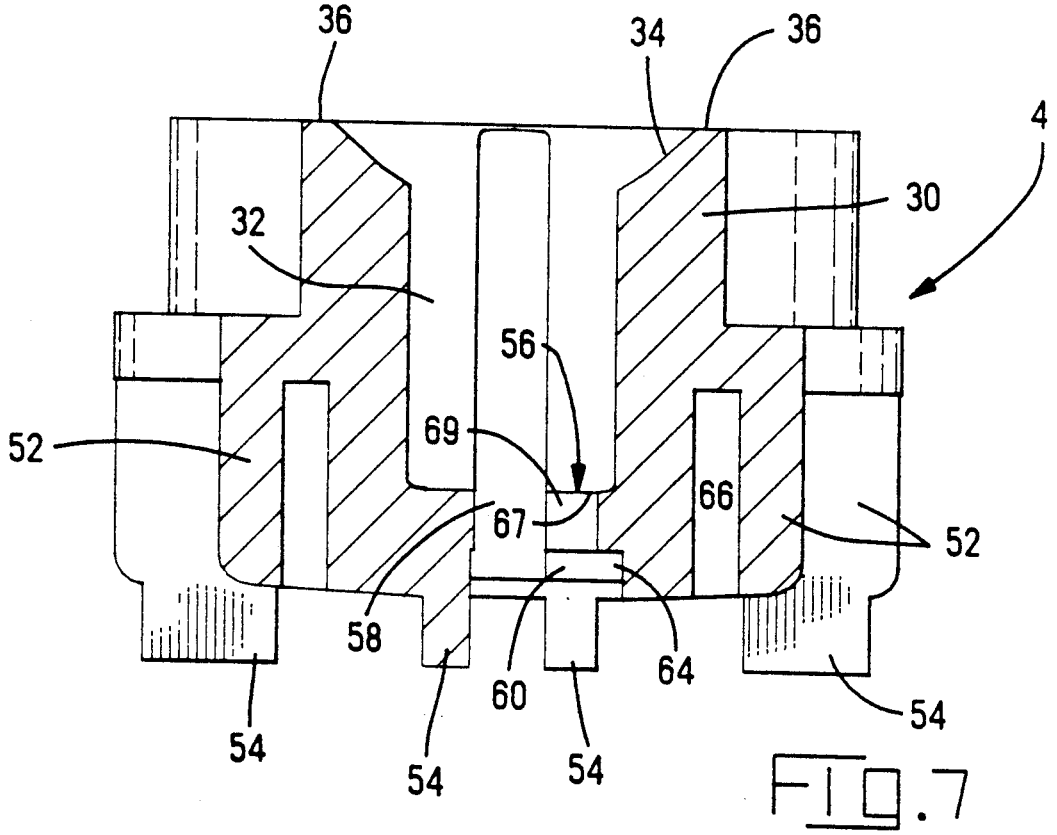
FIG. 7 is a side view of the dielectric housing shown partly in section.

There are formed in the base 28 of the housing 4, on opposite sides of the block 26, two diametrically opposed, through slots 56, which, as best seen in FIGS. 3 and 4, (that is to say both from above and below the base 28) are substantially L-shaped, each having a larger area part 58 and extending therefrom a smaller area part 60. The parts 58 and 60 are, as best seen in FIG. 4, of substantially rectangular, but have a common arcuate side 62 of substantially the same radius as rim 48. As best seen in FIG. 7, each slot 56 is also substantially L-shaped as seen in cross section through the base 28. The radially outer portion of the part 58 of each slot 56 extends into the rim 48, the whole of the part 60 thereof lying within the confines of the rim 48 and communicating with a notch 64 in the rim 48, which notch may be regarded as a shallow extension of the part 60, and the base of which constitutes a latching shoulder 66, which is best seen in FIG. 7. Between the shoulder 66 and the upper surface 67 of the base 28, the base 28 defines an arcuate abutment surface 69.

Figure 9:
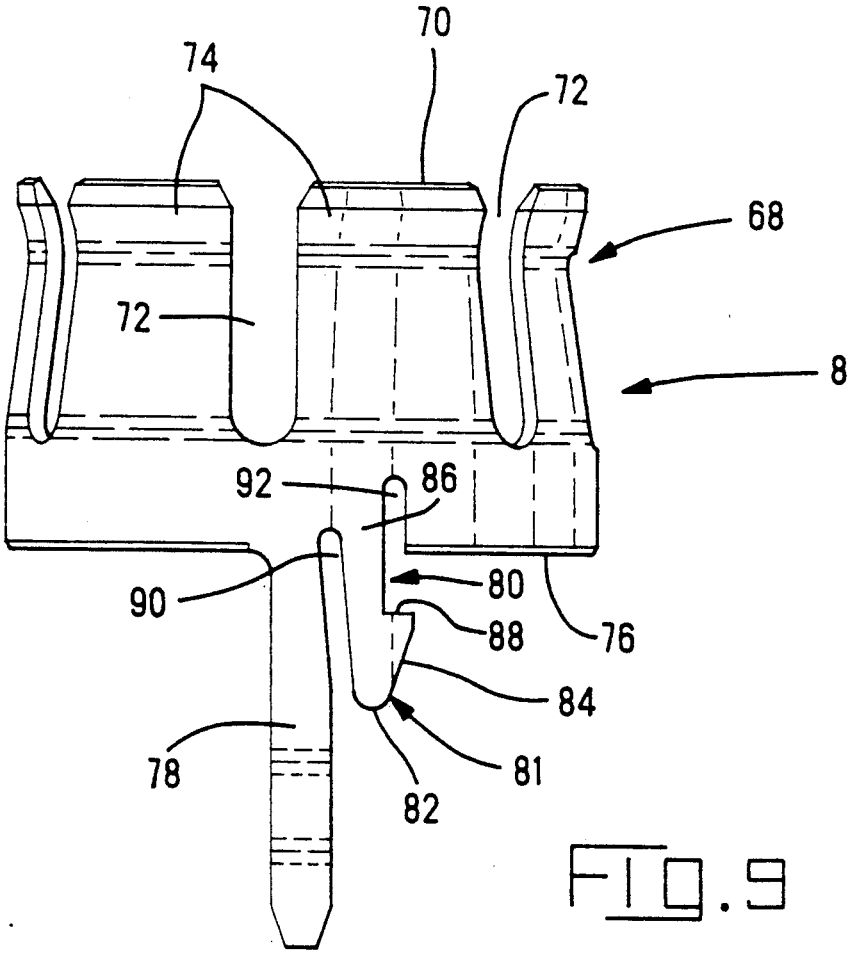
FIG. 9 is a side view of the metal inner shield.
Figure 10A:
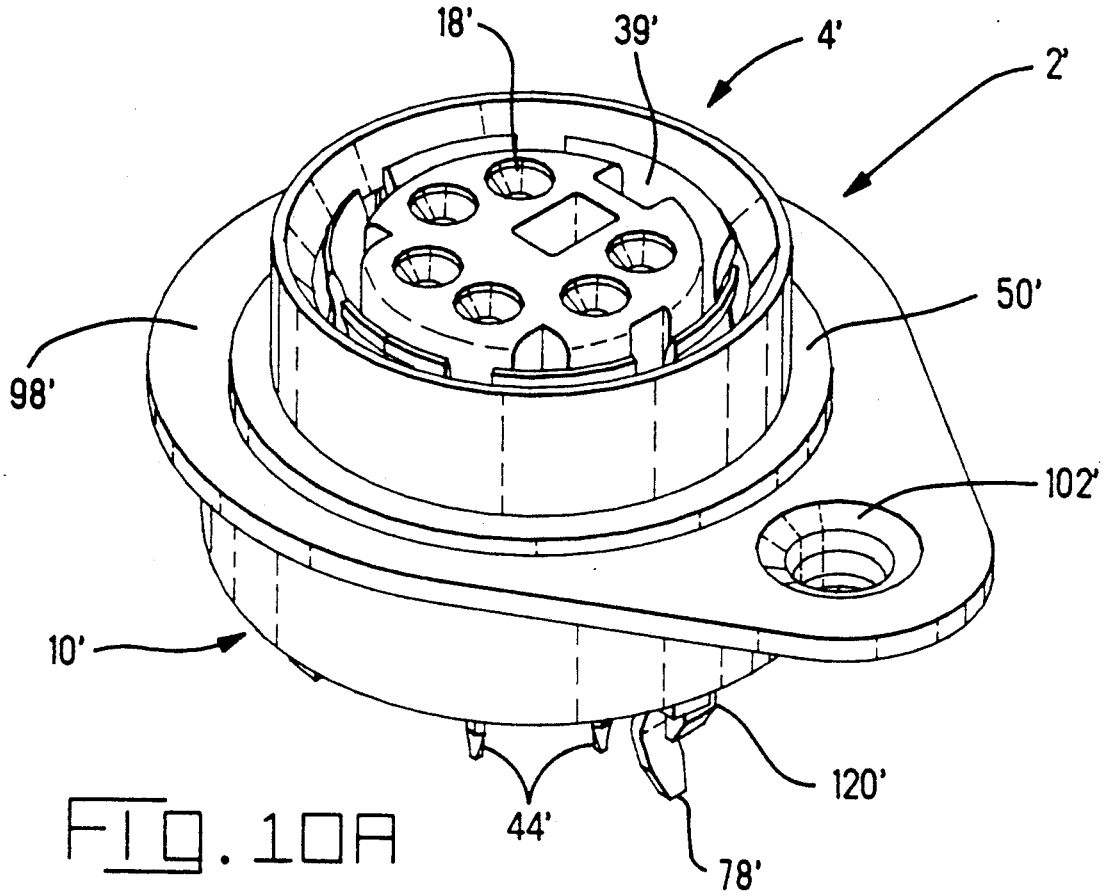
FIGS. 10A to 10D are isometric views of a connector which is otherwise of identical construction to that of FIGS. 1 to 9 but in which the dielectric housing has six terminal receiving positions, FIGS. 10A to 10D showing the dielectric housing located in four respective angular orientations with respect to the outer metal shield of the connector.
Figure 10B:
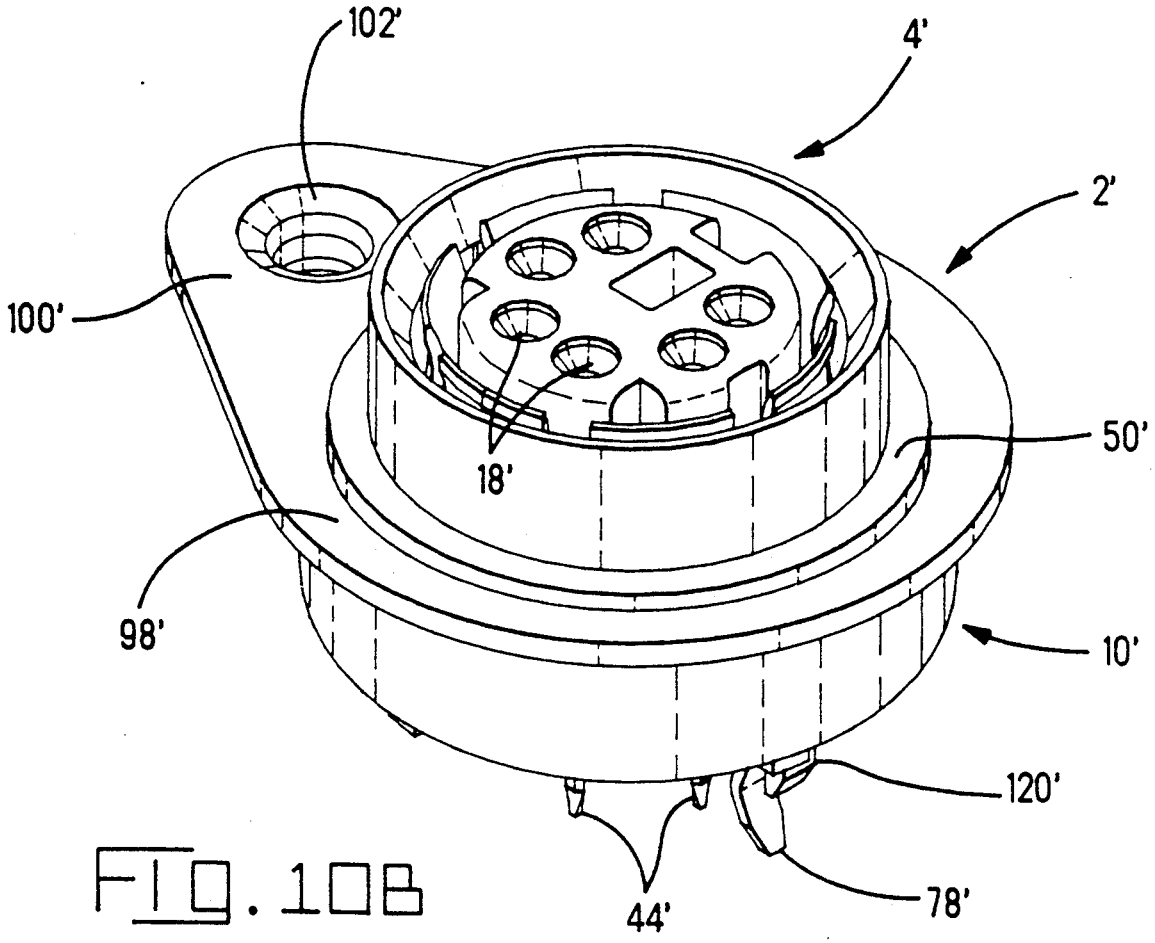
Figure 10C:
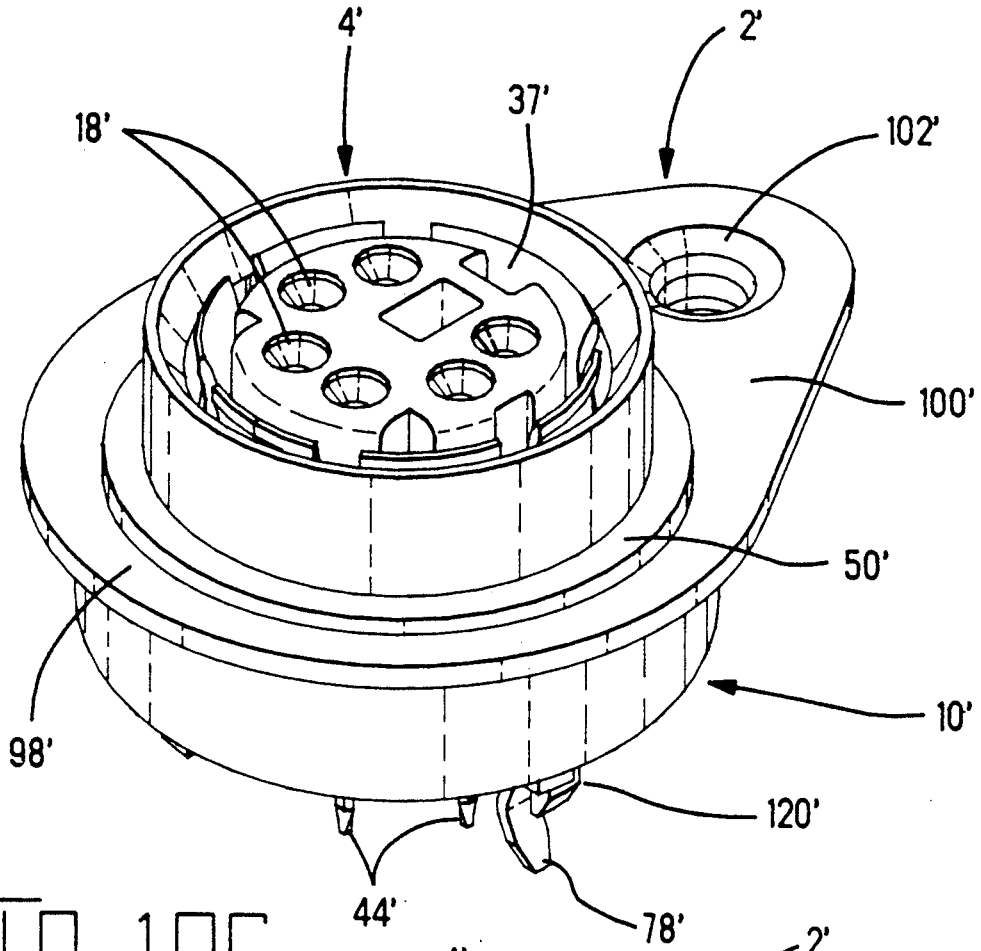
Figure 10D:
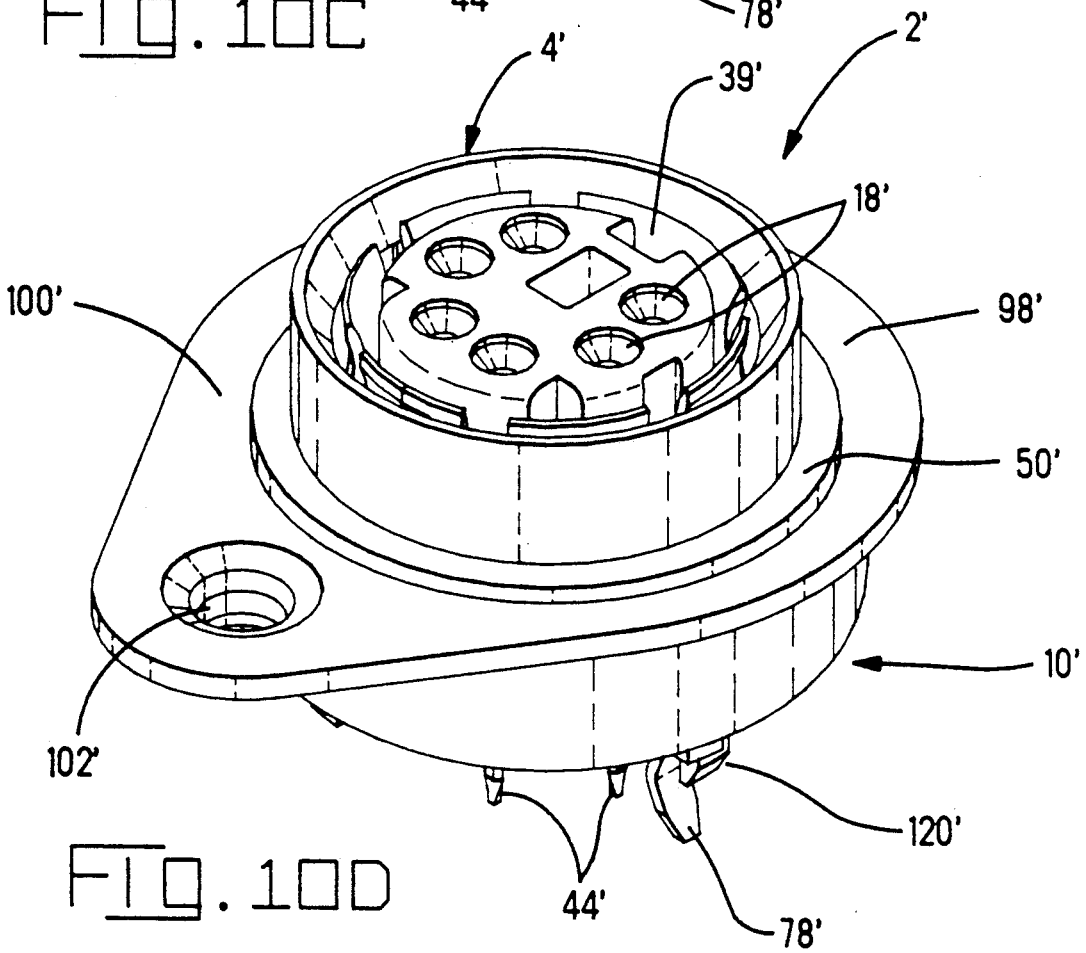

The inner shield 8 which is typically stamped and formed from a single piece of sheet metal stock, comprises as best seen in FIGS. 1, 6 and 9, circular annular body 68 having a radiused mating upper edge 70 from which extends downwardly slots 72 defining a crown of resilient fingers 74. The body 68 has a lower edge 76 from which depend, at diametrically opposite positions, two cantilever spring contact arms 78, and adjacent to each arm 78, a uniplanar, cantilever, barbed, latch arm 80. Each latch arm 80, which has been stamped from said sheet metal stock but which has not otherwise been formed, has, a head 81, having a rounded free end 82. An edge 84 on the side of the head 81 remote from the adjacent arm 78 diverges away therefrom and, towards the edge 76 to define in co-operation with a stem 86 of the latch arm 80, a latching shoulder 88 extending transversely of the stem 86. By virtue of a slot 90 separating the arms 78 and 80, and a slot 92 opening into the edge 76 on the other side of the arm 80, from the slot 90 and defining part of the stem 86, the stem 86 is stiffly and resiliently flexible in its own plane, towards and away from the arm 78.

Figure 2:
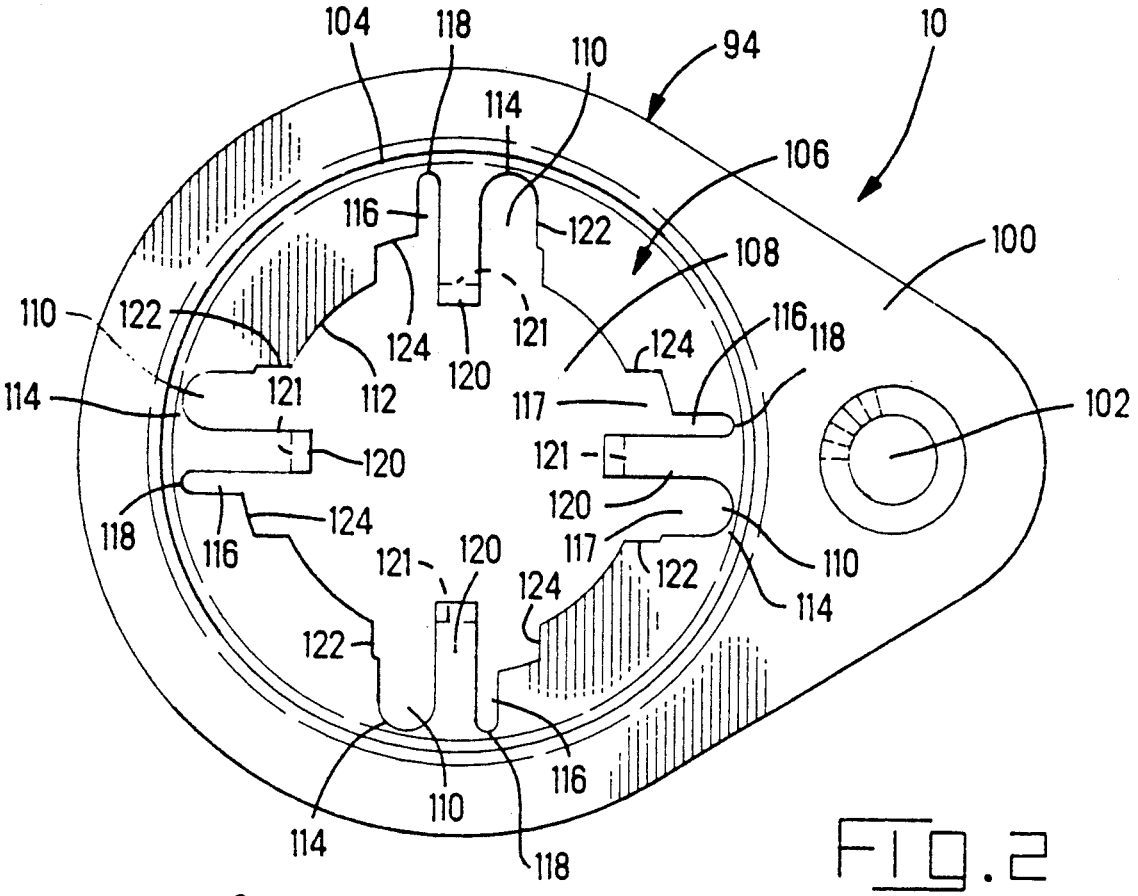
FIG. 2 is a top plan view of the outer shield before it has been prepared for mounting to the dielectric housing.

The outer shield 10 which may be drawn or stamped and formed from a single piece of metal stock, comprises as best seen in FIGS. 1 and 2, a bowl-shaped circular, annular body 94 having a circular side wall 96 surmounted by a radially outwardly extending upper rim 98 from which projects a mounting ear 100 having a through tapped opening 102 therein. The radially inner part of the rim 98 defines an upwardly flared guiding mouth 104. The body 94 has a rudimentary bottom wall 106 defining a central hole 108.

FIG. 2 shows the shield 10 before it has been prepared for assembly to the housing 4. As shown in FIG. 2, the wall 106 has four slots 110 spaced about its inner periphery 112 at regular intervals, each having an outwardly convex base 114. The wall 106 is also formed with four slots 116 each juxtaposed with a respective slot 110 and having an outwardly convex base 118. The radially outer part of each slot 110 is wider than the radially outer part of each slot 118. Each slot 110 and 118 has an enlarged, radially inner mouth 117, all of the mouths 117 being of substantially equal width. The mouth 117 of each slot 110 is provided by a smaller notch 122 in the wall 106, the mouth 117 of each slot 118, being provided by a larger notch 124 in the wall 106. Notches 122 and 124 are clearance for inner shell head 81. Between each pair of adjacent slots 110 and 116 is a radially inwardly projecting soldering tab 120, the underside of which has a chamfered free end portion 121. It may be said that each pair of slots in fact constitutes a common notch from the base of which the soldering tab projects.

Before the shield 10, as it is shown in FIG. 2, is assembled to the housing 4, two diametrically opposed ones of the tabs 120 are bent down, as will best be apparent from FIG. 1, to depend below the shield 110 and the two remaining tabs 120 are sheared off back from 15 the mouths 117 to leave stubs 120'.

Figure 8:
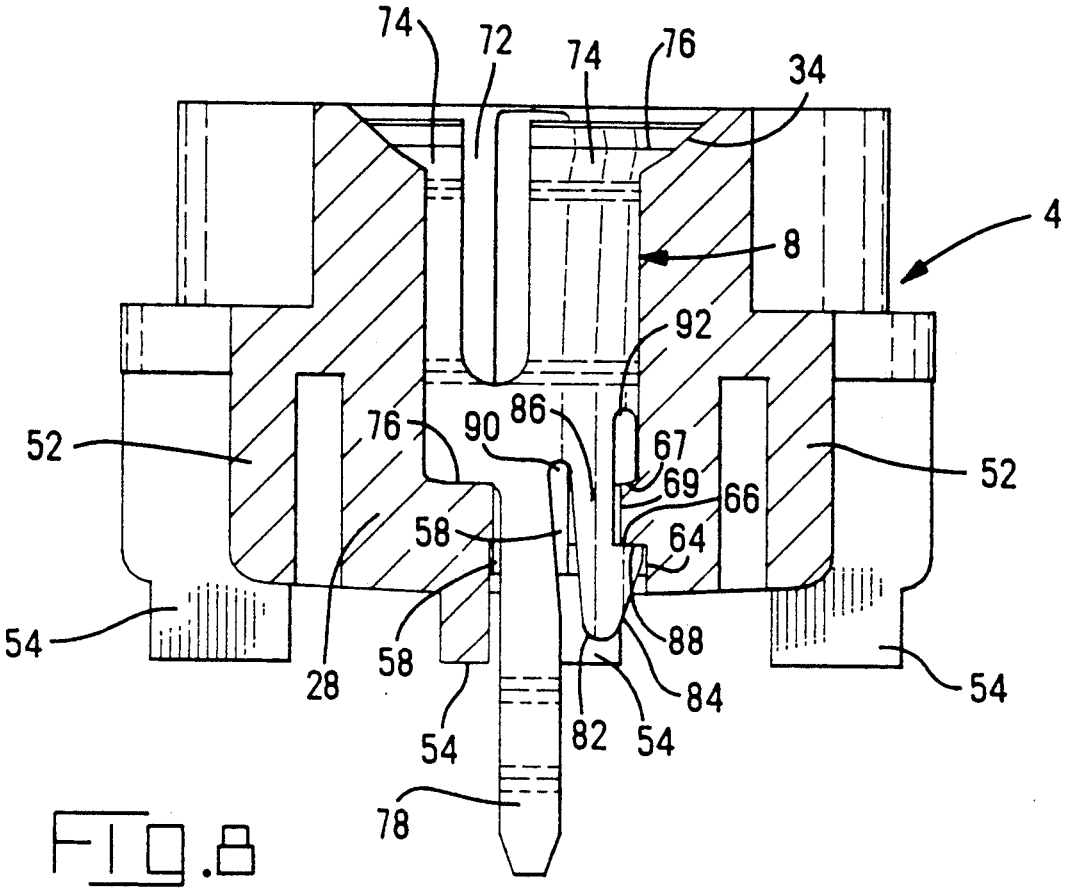
FIG. 8 is a similar view to that of FIG. 7 but showing the metal inner shield when assembled to the dielectric housing.

The manner in which the parts of the connector 2 are assembled, will now be described. The inner shield 8 is assembled to the housing 4, by inserting it, with the spring arms 78 leading, into the chamber 32 of the housing 4, guided by the flared mouth 34 of the hood 30, so that each arm 78 passes through the part 58 of a respective slot 56 until the edge 76 of the shield 8 bottoms on the base 28 of the housing 4, as best seen in FIG. 8, and the outer surface of the edge 70 of the shield 8 is spaced from the surface of the mouth 34. During the insertion of the shield 8, the inclined edge 84 of the head 81 of the latch arm 80, guided by its rounded end 82 engages the abutment surface 69 of the base 28 and is thereby cammed resiliently towards the adjacent spring arm 78 by flexure of the stem 86 until the shoulder 88 of the head 81 passes the latching shoulder 66, when the stem 86 instantly resiles so that the shoulder 88 engages under the shoulder 66 in latching relationship therewith, whereby the shield 8 is firmly latched against withdrawal from the housing 4 with the spring arms 78 projecting there beneath.

The housing 4 is then press fitted into the outer shield 10 which defines a circular seat therefor, the ribs 52 guided by the mouth 104 of the shield 8 engaging the inner face of the wall 96 of the shield 10, until the base 28 of the housing 4 bottoms against the rudimentary bottom wall 106 of the shield 10, the rib 50 engaging tightly against the interior of the shield 10, as best seen in FIGS. 5 and 6. For the press fitting operation, the housing 4 is so angularly oriented about the axis X—X with respect to the shield 10, that as the housing 4 approaches its fully inserted position in the shield 10, each of the lugs 54, passes through the opposed notches 110 and 122 of a respective pair thereof, to depend below the wall 106 when the housing 4 has been fully inserted into the shield 10.

Alternatively, the housing 4 could be initially assembled to the outer shield 10, the inner shield 8 being then assembled to the housing 4.

When the parts of the connector 2 have been assembled as described above, the connector 2 is mounted to a circuit board (PCB) as shown in FIG. 6 with the axis of the connector 2 extending vertically. In this surface mounted position of the connector 2, the spring arms 78 of the inner shield 4 and the bent down tabs 120 extend through large, internally metal plated holes H2 in the PCB, so that each tab 120 urges the adjacent spring arm 78 against the metal lining of the hole H1, the tails 44 of the terminals 12 extending through smaller, internally metal plated holes H2 in the PCB. Since the chamfered end portions 121 of the tabs 120 which have been bent down, are radially outwardly directed, the portions 121 serve to guide the tabs 120 into the holes H1. Connector 2 is secured to the PCB a soldering operation, for example a wave soldering operation in which the tabs 120 are to be soldered to ground conductors (not shown) on the PCB and the tails 44 to signal conductors (not shown) on the board. A bolt B, which is shown in broken lines in FIG. 6, is screwed into the tapped opening 102 in the mounting ear 100 of the shield 10 to establish a common ground between the panel and shield 10. The lugs 54 serve to stand the housing 4 off from the PCB so that the housing 4 is protected from damage by the soldering heat and to wash underneath the housing subsequent to soldering.

In use, the assembled and surfaced mounted connector 2 can be mated with a circular, shielded DIN pin connector (not shown) having projecting pins for mating with the receptacle part 4 of a respective terminal 12 of the connector 2 and a shield having a projecting portion for insertion between the fingers 74 and the block 26 of the connector 2. The mating DIN connector may, for example, be mounted on a further printed surface board to extend vertically therefrom.

In order to allow the connector 2 to be so mated, its housing 4 must be angularly positioned with respect to the shield 10 so that the terminals 12 are so angularly located as to be compatible with the angular location of the pins of said mating connector and the polarization features 37 and 39 and the key 38 are angularly located so as to be compatible with the angular location of corresponding keying means of the mating connector. By virtue of the provision of the lugs 54 and the pairs of opposed notches 122 and 124, said lugs and said pairs of notches being four in number, the housing 4 can be mated for discrete angular positions with respect to the outer shield 10 by selecting the particular lug 54 which is to be inserted into each pair of opposed notches 120 and 122, by appropriately angularly positioning the housing 4 with respect to the shield 10 prior to its insertion thereinto.

FIGS. 10A to 10D show by way of example a six position connector 2' which is constructed in exactly the same way as the connector 2 except for the number of terminal receiving cavities, and the parts of which bear the same reference numerals as those used in FIGS. 1 to 9 but with the addition of a prime symbol. Each of FIGS. 10A to 10D shows the housing 4' in a respective one of four different angular orientation with respect to the outer shield 10'.

In practice, the dielectric housing will usually have between three and eight terminal receiving cavities.

By virtue of the construction of the inner shield, the latch arms are robust and are easily produced by a simple stamping operation as the inner shield is being made by progressive die forming. Since the stems of the latch arms are stiffly resilient in their own planes, their latching action is positive and thus completely reliable, this being of particular advantage since the inner shield may be subjected to some tensile stress when the shield of the mating connector is withdrawn therefrom.

While the preferred embodiment has been described with respect to specific features, orienting the connector housing in any one of several orientations within a shield can be achieved by features on the housing repeated at regular intervals around an axis of rotation. A symmetrical protrusion, or protrusions that collectively form a symmetrical protrusion, on the housing receivable in a corresponding symmetrical aperture or recess in the shield to provide multiple orientations of the housing relative to the shield. The housing opening would typically have features repeated therearound at regular intervals such that when the connector housing is rotated about the center point of the repeated features the protrusion is cooperable with the aperture or recess in multiple relative orientations. A rectangular aperture would provide two orientations; an equilateral triangle would provide three orientations; a square would provide four orientations, etc. Of course, the features herein described as being on the connector housing could be on the shield with complementary structure on the housing to achieve the multiple orientation capability.

We claim:

1. A shielded electrical connector, comprising:

a dielectric housing having a longitudinal axis and defining a central block having a mating face and an opposite face extending transversely of said axis, a hood surrounding said central block in spaced relationship therewith and a base connecting the hood to said central block at a position remote from its mating face, the hood, the central block and said base, cooperating to define a chamber, said base defining a latching opening located between the central block and the hood and communicating with the chamber, a wall of the latching opening defining a first latching shoulder extending transversely of said axis and an abutment surface extending in the direction thereof and being adjacent to the latching shoulder, a plurality of terminal receiving cavities in the central block opening into the mating face thereof and into said opposite face, each for receiving an electrical terminal; and a one piece, stamped and formed annular metal shield for reception in the chamber having an edge for engaging said base, a uniplanar latch arm for insertion into the latching opening having a stem extending from said edge and being stiffly and resiliently deflectable in its own plane, a head on the stem being provided with a cam surface for engagement with said abutment surface, as said latch arm is being initially inserted into the latching opening, to deflect the stem of the latch arm transversely of said axis in a first sense, a second latching shoulder extending from said cam surface transversely of the stem for engagement under said first latching shoulder upon said stem resiling in a second and opposite sense, when the second latching shoulder passes the first latching shoulder as the latch arm is inserted into said opening.

2. An electrical connector as recited in claim 1, wherein the central block has a circular cross-section.

3. A connector as claimed in claim 1, comprising a peripheral rim on a side of said base remote from the circular chamber, the first latching shoulder being defined by a recess in the peripheral rim into which recess said latching opening opens.

4. A connector as claimed in claim 3, wherein said latching opening communicates with a further opening in said base, part of which opens into said rim, a spring arm extending from said edge of the metal shield being insertable through said further opening to project from the dielectric housing.

5. A connector as claimed in claim 1, wherein said opening in said base is a through opening, a further through opening in the base communicating therewith, a spring extending arm from said edge of the metal shield in juxtaposition with said latch arm being insertable through said second opening to project from the dielectric housing.

6. A connector as claimed in claim 5, further comprising an outer metal shield for receiving the dielectric housing and a tab projecting from the outer metal shield for insertion into an internally plated metal hole in a circuit board and for urging the spring arm against metal plating in the hole.

7. A dielectric housing for a shielded electrical connector, the housing comprising;

a base having a first side and a second side opposite to the first side;

a central block having a mating face and an opposite face, a plurality of electrical terminal receiving cavities opening into both of said faces, a hood surrounding the central block, and the central block, projecting in the same direction from the base normally thereof in spaced relationship to define a shield receiving chamber therebetween; and opening wall means in the base defining a plurality of openings extending therethrough in angularly spaced relationship between the central block and the hood, and each opening into both of said first and second sides of the base, each opening having a larger cross section first portion and a smaller cross section second portion extending from the first portion circumferentially of said base and communicating at its end remote from the first portion with a recess extending into said second side of the base to define a latching shoulder extending transversely of said openings, wherein the first portion of each opening is of substantially rectangular cross section, the second portion thereof being of elongate substantially rectangular cross section and said portions having a common wall of arcuate cross section and the radius of which conforms with that of the central block.

8. A dielectric housing as recited in claim 7, wherein the central block has a circular cross-section.

9. A shield for a shielded electrical connector, and which has been stamped and formed from a single piece of sheet metal stock, the shield comprising;

an annular body having upper and lower edges, a plurality of parallel slots opening into the upper edge of the body to define a crown of spring fingers; and a plurality of uniplanar latch arms spaced from each other circumferentially of the annular body and each comprising a stem projecting from said lower edge substantially normally thereof and a head provided on the stem at a position remote from the lower edge of the body, the head terminating in a rounded free edge, a lateral edge of the head merging with said rounded edge and diverging therefrom towards said lower edge of the annular body, said lateral edge being connected to said stem at the end of said lateral edge nearest to the annular body, by a locking shoulder extending from said lateral edge in substantially parallel relationship with said lower edge of the annular body, further comprising a plurality of spring arms each projecting from said lower edge of the annular body in juxtaposed relationship with a respective one of the latch arms and being separated therefrom by a first slot, a portion of the longitudinal edge of the stem of each latch arm, proximate to the said lower edge of the annular body and being remote from said spring arm, being defined by a second slot opening into said lower edge of the annular body and extending substantially normally of that edge.

10. A shield as claimed in claim 9 wherein the cross section of the body is circular.

11. A shield for a shielded electrical connector, and which has been stamped and formed from a single piece of sheet metal stock, the shield comprising;

an annular body having upper and lower edges, a plurality of parallel slots opening into the upper edge of the body to define a crown of spring fingers; and a plurality of uniplanar latch arms spaced from each other circumferentially of the annular body and each comprising a rectilinear elongate stem projecting from said lower edge substantially normally thereof and being resiliently deflectable in its own plane, and a head provided on the stem at its end remote from the lower edge of the body, and extending away from said lower edge and in line with the stem, the head terminating in a rounded free edge directed away from the lower edge of the body, a lateral edge of the head merging with said rounded edge and diverging therefrom towards the lower edge of the annular body and said lateral edge being connected to said stem at the end of said lateral edge nearest to the lower edge of the annular body by way of a locking shoulder extending from said lateral edge substantially at right angles to said stem.

* * * * *